US005228887A

United States Patent [19]

Mayer

[11] Patent Number: 5,228,887

[45] Date of Patent: Jul. 20, 1993

[54] FIREARM ESPECIALLY HUNTING RIFLE WITH EXCHANGEABLE BARREL, AND MODULAR SYSTEM FOR SUCH A FIREARM

[76] Inventor: Karl K. Mayer, Liptiner Strasse 25, 5760 Arnsberg 1, Fed. Rep. of Germany

[21] Appl. No.: 613,487

[22] PCT Filed: Mar. 1, 1990

[86] PCT No.: PCT/EP90/00341

§ 371 Date: Oct. 30, 1990

§ 102(e) Date: Oct. 30, 1990

[87] PCT Pub. No.: WO90/10841

PCT Pub. Date: Sep. 20, 1990

[30] Foreign Application Priority Data

Mar. 1, 1989 [DE] Fed. Rep. of Germany ..... 3906496

[51] Int. Cl.[5] ..... F41A 21/48; F41A 11/02

[52] U.S. Cl. ..... 42/75.02; 42/77

[58] Field of Search ..... 42/77, 75.02, 75.01, 42/49.02; 89/128

[56] References Cited

U.S. PATENT DOCUMENTS

| | | | |
|---|---|---|---|
| 1,428,081 | 9/1922 | Fuchs | 42/75.02 |
| 2,327,568 | 3/1945 | Grigg | 42/75.02 |
| 2,679,123 | 5/1954 | Williams | 42/75.02 |
| 3,003,400 | 10/1961 | Johnson | 42/75.02 |
| 3,444,641 | 5/1969 | Ruger | 42/75.02 |
| 3,611,607 | 10/1971 | Donnell | 89/128 |
| 3,842,527 | 10/1974 | Low | 42/75.02 |
| 4,297,800 | 11/1981 | Atchisson | 42/49.02 |
| 4,515,064 | 5/1985 | Hohrein | 89/128 |
| 4,729,186 | 3/1988 | Reiger | 42/77 |

FOREIGN PATENT DOCUMENTS

| | | | |
|---|---|---|---|
| 0174901 | 3/1986 | European Pat. Off. . | |
| 2207555 | 1/1983 | Fed. Rep. of Germany | 42/77 |
| 3326521 | 1/1985 | Fed. Rep. of Germany . | |
| 655125 | 7/1951 | United Kingdom . | |

*Primary Examiner*—Michael J. Carone

*Attorney, Agent, or Firm*—Henry M. Feiereisen

[57] ABSTRACT

A modular system for hunting rifles comprises barrels (13) of different caliber which can be attached via a barrel-mounted positioning rail (19) to a respective mounting tongue (11) of a stock which represents the basic unit. The stock can be constructed as long or short repeating rifle or as single-shot rifle so that any combinations of calibers and weapon types can be assembled. At its end, the barrel has a locking bush with locking lugs which cooperate with complementary locking lugs of an exchangeable bolt head (47). A longitudinal guidance system for the breech may be accommodated outside the breech area below the barrel, especially between positioning rail (19) and mounting tongue (11) to thereby attain a short overall length of the weapon. Also, through providing the locking bush with a downwardly directed cutout (53) which allows the passage of the projectile nose of a cartridge, the overall length can be further reduced.

19 Claims, 4 Drawing Sheets

FIG. 10
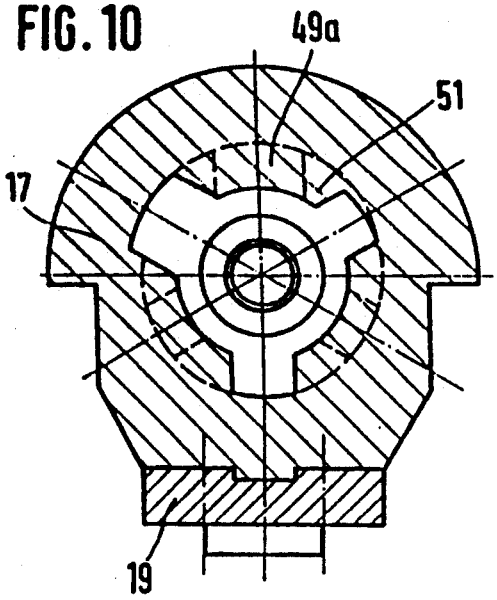
FIG. 13
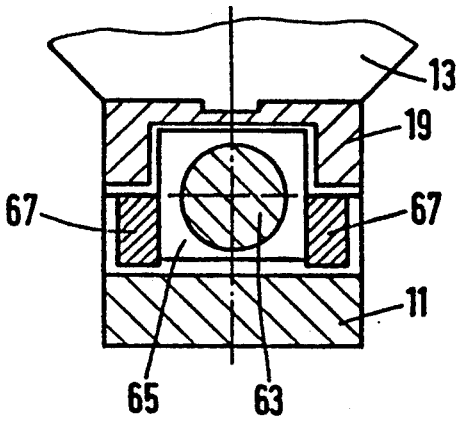
FIG. 12
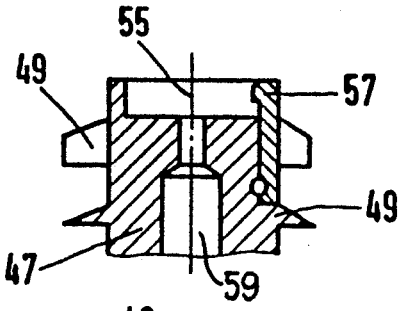
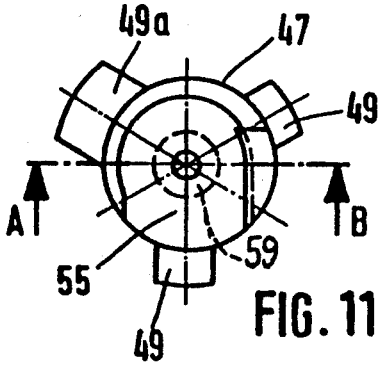
FIG. 11

FIREARM ESPECIALLY HUNTING RIFLE WITH EXCHANGEABLE BARREL, AND MODULAR SYSTEM FOR SUCH A FIREARM

DESCRIPTION

The invention refers to a firearm, especially a hunting rifle with exchangeable barrel of the type having exchangeable barrel and cylinder breech.

Recently, there is an increasing demand on available weapons to be more versatile and customized for the hunter in order to satisfy the variety of hunting needs, especially in view of increased prosperity of the hunting consumer and an increase of hunting trips abroad where the hunting terrain and game varies considerably from the domestic hunting. To adapt to these different conditions, on the one hand, weapons are desired for very different types of ammunition and calibers, including especially high-power repeating rifles for magnum calibers for extreme hunting, and, on the other hand, different types of weapons within one and the same caliber, such as conventional repeating rifles of long design, repeating rifles of short design and high-power single firearms also of short design. To acquire and to make available for each of these applications a suitable complete weapon is not only very inconvenient for the hunter and unrealistic when going on hunting trips but would also require the making of an immeasurably great number of various types of weapons which frequently are produced only in smallest numbers. A solution of these problems are modular weapon systems in which a stock including a breech mechanism is selectively provided with exchangeable barrels for different ammunition calibers. In this manner, the hunter is able to assemble a weapon suitable for the existing hunting conditions or to subsequently reassemble the weapon according to varying demands.

However, existing systems for hunting rifles with exchangeable barrel have various drawbacks. On the one hand, the connection of the exchangeable barrel to the stock is either not sufficiently precise or is attained only at impairment of the vibration behavior of the barrel, and, on the other hand, although various barrels can be combined with one and the same stock, one and the same barrel cannot be combined with different stocks, e.g. repeating rifle systems of varying overall length, so that the versatility attainable in principle with a modular system is not fully exhausted.

The invention is based on the object to create a firearm of the above-mentioned type, especially in form of a hunting rifle, which can be assembled in form of a modular system in a number of weapon types with varying barrel and breech mechanism for various types of ammunition and types of caliber, whereby the coupling of the barrel to the stock is accomplished at high precision without impairing the vibration behavior of the barrel so as to attain a reproducible target area upon exchange of the barrel, and whereby a breech is realized which is suitable for various repeating rifle systems and includes a guidance accommodated in space-saving manner.

The object is attained in accordance with the invention by defining the coupling element of the barrel as a positioning rail which parallels the barrel and has a rearward part fixedly secured to the barrel in the area of the cartridge chamber and a forward part extending without contacting the barrel, by defining the coupling element of the stock as a mounting tongue which extends over the length of the positioning rail and includes at least at its forward and rearward ends fastening elements which interlock with the positioning rail, and by arranging the guide means for the breechblock below the barrel in the area of the mounting tongue. The dependent claims refer to further advantageous embodiments of the weapon and modular system, respectively, in accordance with the invention.

Embodiments of the invention will now be described in more detail with reference to the drawings in which:

FIG. 10 shows an axis-vertical section through the locking bush of a barrel;

FIG. 11 shows a front view of a bolt head;

FIG. 12 shows a longitudinal section through the bolt head taken along the line A-B in FIG. 11;

FIG. 13 shows a schematic cross section through the guidance of the breech mechanism in the area of the sectional line A-B of FIG. 1.

Figure 1:
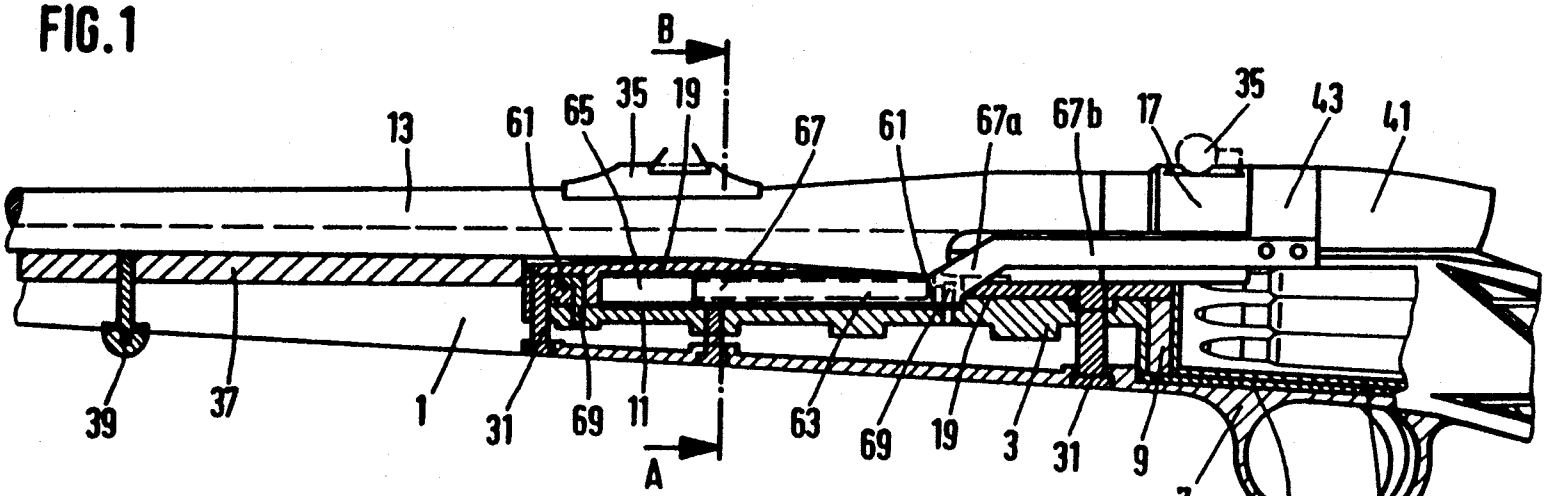
FIG. 1 shows a partially sectional side view of a firearm in form of a short hunting rifle.

The hunting repeating rifle illustrated partly in FIG. 1 includes a stock 1 which accommodates, preferably in one piece, a system frame 3 made of resistive metal. Mounted to the system frame 3 is a magazine well 4 for receiving the ammunition box 5 and the trigger guard 7. The magazine box 5 is secured within the system frame 3 by a locking bar 9. The system frame 3 is forwardly extended in direction of the barrel in one piece by a mounting tongue 11 for allowing attachment of the exchangeable barrel 13.

Figure 3:
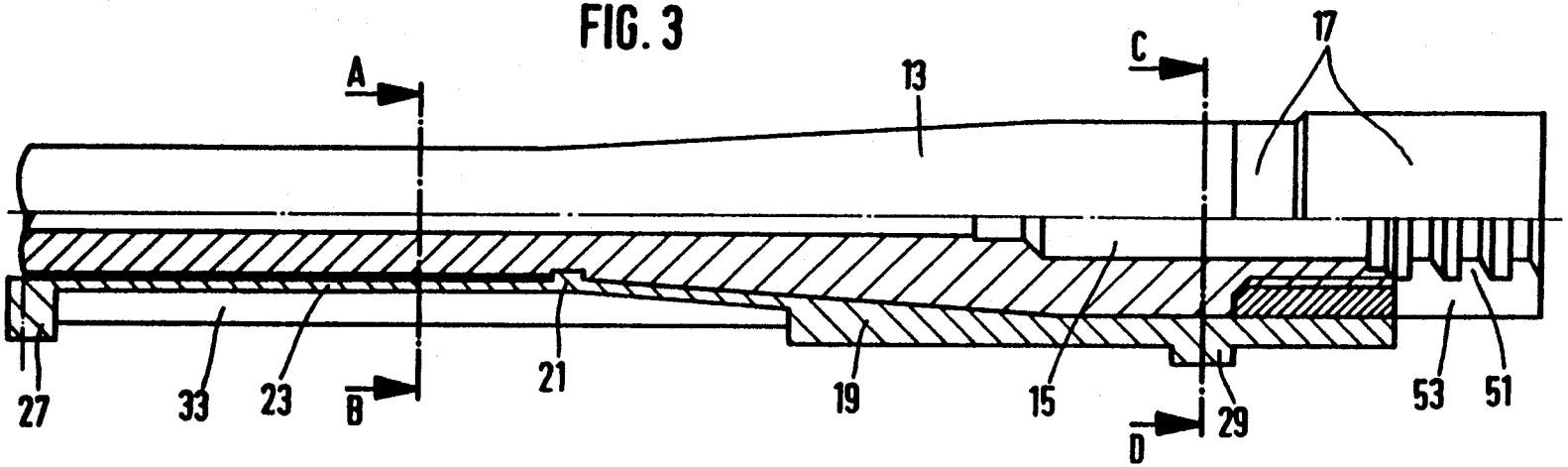
FIG. 3 shows a side view of an exchangeable barrel with coupling rail.
Figure 5:
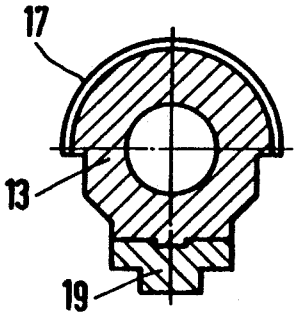
FIGS. 4 and 5 show sections taken along the lines A-B and C-D in FIG. 3.
Figure 4:
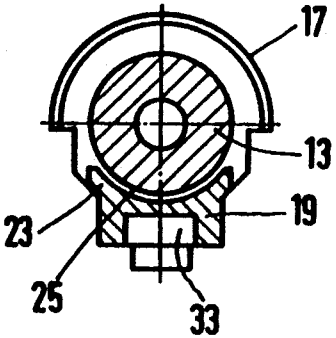

The barrel 13 illustrated in detail in FIGS. 3, 4 and 5 includes in the area of the barrel root an enlargement in which the cartridge chamber 15 is arranged, and in succession thereof a locking bush 17 which is mounted to the barrel end, e.g. by threaded engagement or in nondetachable manner by shrink-fitting, welding or the like. This locking bush 17 cooperates in a manner still to be described with a bolt head of the breech mechanism.

Extending along the underside of the barrel 13 is a positioning rail 19 for attaching and securing a barrel to the mounting tongue 11 of the stock. This positioning rail 19 extends from about the barrel end to under the thinner part of the barrel 13 disposed before the barrel root. In the area of the barrel root and its conical taper, the positioning rail 19 is fixedly secured to the barrel 13, preferably in form-fitting manner via a tongue-and-groove joint, as illustrated in FIG. 5, and through multiple threaded engagement via fastening screws which are arranged in two rows on both sides of the center plane of the barrel (not shown). Starting from the thinner part of the barrel, where an additional engagement point 21 is provided between the positioning rail 19 and the barrel 13, the positioning rail 19 includes an upwardly directed concavely rounded section 23 which in this area matches the round outer contour of the barrel 13 but is spaced therefrom under formation of a small gap 25 of e.g. 0.2 mm so as to extend free of contact along the barrel 13, as can be seen from FIGS. 3 and 4. The positioning rail 19 may be connected to the mounting tongue 11 of the stock at a forward point of attachment 27 and a rearward point of attachment 29 by means of fastening screws 31 (FIG. 1) to thereby secure the entire barrel 13 against recoil and to mount the barrel 13 in very precise alignment to the stock. On the other hand, by connecting only part of the length of the positioning rail 19, that is in the area of the barrel root, with the barrel 13, it is ensured that the entire area of the barrel extending before the barrel root can freely oscillate relative to the positioning rail 19 and thus to the stock 1. Such a braceless and freely oscillating attachment of the barrel is of particular importance for the firing accuracy and reproducible target area. FIG. 5 further shows that in the area of the barrel root the barrel 13 has a semicircular contour only at its upper side, whereas at its lower area the barrel 13 has a polygonal contour which not only permits the provision of the tongue-and-groove joint with the positioning rail 19 but is also advantageous for an adaptation of the barrel flanks to the guidance system for the breech mechanism which is still to be described. Further, FIG. 3 and FIG. 4 illustrate a downwardly extending grooved recess 33 in the forward area of the positioning rail 19 for partly accommodating a guidance system for the breech which guidance system is still to be described in detail.

As shown in FIG. 1, it is possible to arrange between the thinner part of the barrel and the stock 1 an exchangeable contour compensating element 37 which is adapted to the outer contour of the respective barrel 13 and bridges the intermediate space between stock 1 and barrel 13 except for an air gap required for the barrel vibration. This compensating element 37, which is also replaced upon exchange of the barrel 13 with a thicker or thinner barrel, is preferably a light and torsion-resistant element of glass fiber reinforced plastic material so as to serve simultaneously for stabilization of the forward stock 1 which has a tendency to easily twist. A swivel screw 39 secures the compensating element 37 to the stock. FIG. 1 further illustrates mounting points 35 at the upper side of the barrel 13 for allowing attachment of the conventional aiming telescope.

As can be seen from FIG. 1 and FIGS. 6–9, the breech mechanism is designed in form of a bolt-action and includes a breechblock 43 which is slidably arranged in front of a breech cover 41 and in which a bolt head 47 is supported and rotatable by means of a handle 45. The bolt head 47 carries radially projecting locking lugs 49 which can be brought into engagement with corresponding counter lugs of the locking bush 17 by forward sliding and rotation of the bolt head 47 so that after insertion of a cartridge (e.g. 50 on FIG. 7) through the locking bush 17 into the barrel 13, the bolt head 47 can be interlocked with the locking bush 17 to thereby form the breech bottom. According to an essential feature of the invention, the bolt head 47 is exchangeably arranged e.g. by being threadably engaged with a screw shaft which is connected with the handle 45. The various exchangeable bolt heads 47 are characterized by a different number of groups of locking lugs 49. As illustrated in FIGS. 6–9, the bolt heads 47 may be provided with one, two, three or four groups of locking lugs 49 arranged in a same plane and in correspondence with the number of groups of counter lugs of the locking bushes 17 of the respectively exchangeable barrel 13, wherein the locking bushes 17 may also be of varying length. Thus, the locking of the bolt head at the barrel is accomplished with varying strength and stability depending on the prevailing barrel caliber. For small calibers such as 0.222 Remington (FIG. 6), a single set of locking lugs is sufficient, while for increasingly greater calibers such as 7×64 (FIG. 7), for 0.300 Winchester Magnum cartridges (FIG. 8) or for special magnum cartridges (FIG. 9) an increasingly greater number of two, three or four groups of locking lugs are required in order to ensure a secure locking at the prevailing forces.

According to FIG. 12, each of the one, two, three or four groups of locking lugs includes three locking lugs 49 which are arranged at angular distances of 120°. Correspondingly, according to FIG. 10, the locking bush 17 is provided with three counter lugs 51 offset by 120° with intermediate gaps for passage by the locking lugs 49. As illustrated in FIGS. 10 and 11, the one locking lug **49*a*, which is upwardly directed in locking position, is bigger i.e. wider as well as higher than both the other locking lugs 49 so that the forces encountered above the barrel axis are received by the locking lug 49*a* at approximately same surface pressure as are the forces below the barrel axis by the two other locking lugs 49. As can be seen from FIG. 12, the locking lugs 49 have a trapezoid cross section, as viewed from the side and in axial section, respectively, with an axis-vertical rear flank which receives the locking forces and with a slanted, i.e. conical, forward flank. Complementary thereto are the counter lugs 51 of the locking bush 17 as illustrated in FIGS. 6–9** to thereby attain an optimal strength and stability of the locking mechanism at optimal short axial overall length.

A further important feature for attaining a short overall length is depicted in FIGS. 3 and 6–9. This feature resides in that the locking bush 17 is downwardly open at its rear part i.e. it includes a downwardly directed cutout 53 which is dimensioned and shaped in such a manner that the passage of the projectile nose of the cartridge 50 is allowed in vertical and transverse-axial direction, respectively, when the cartridge is pushed from the magazine into the loading position. This means that the distance between the end faces of the locking bush 17 and the bolt head 47 in loading position can be shorter than the length of the respectively used cartridge to thereby attain a valuable reduction of the overall length of the entire breech mechanism. Thus, the entire weapon can either be shorter or, at same weapon length, a longer barrel can be used at improved hitting accuracy.

As shown in FIGS. 11 and 12, the end face of the bolt head 47 is recessed to define a depression 55 for receiving the cartridge bottom of the cartridge 50 being in loading position. This depression 55, too, is downwardly open as shown in FIG. 11, i.e. cut out, so that also the bottom section of the cartridge can be inserted in transverse-axial direction from below into the depression 55 of the bolt head 47 to thereby provide a further shortening of the overall length of the breech mechanism.

A part of the lateral boundary of the depression 55 is defined by a pullout claw 57 which is swingably supported to the bolt head 47 by means of a pin. The forward hook of the claw locks behind the projecting edge of the cartridge bottom which is pushed behind the hook of the pullout claw 57 during axis-vertical insertion of the cartridge into the depression 55. The pullout claw 57 ensures extraction of the empty cartridge case during opening of the breech from the cartridge chamber 15 of the barrel 13 so that the empty cartridge can be ejected from the opened breech when the next cartridge is subsequently advanced from the magazine.

FIGS. 11 and 12 also illustrate the central bore 59 of the bolt head 47 through which the striking pin (not shown) of the trigger mechanism can act on the cartridge. Because of the short overall length of the entire system and the accordingly short stroke length of the striking pin, it is required to load the striking pin with a space-saving spring which still applies the required force for acceleration of the striking pin. Preferably a helical spring is used which is made by winding spring wire of rectangular shape.

The breechblock 43 which rotatably supports the bolt head 47 is slidably guided in longitudinal direction by means of a guidance system which is arranged in space-saving manner below the positioning rail 19 of the barrel 13. As can be seen from FIG. 1 and FIG. 13, this guidance system includes a round guide bar 63 mounted between end blocks 61 and slidably guiding a guide bush 65 which is of rectangular outer contour and is partly surrounded by the recess 33 of the positioning rail 19. Mounted to the lateral faces of the guide bush 65, e.g. by means of screws (not shown), are two connecting straps 67. These connecting straps 67 which initially extend parallel to the guide rod 63 include subsequently a slantingly ascending section 67*a* and then a section 67*b* which parallels again the barrel axis and extends laterally next to each flank of the polygonal lower cross sectional half of the barrel 13 and the locking bush 17, respectively, (see also FIG. 6) and is laterally bolted to the breechblock 43. Thus, the guidance for the breechblock 43 is not housed in the area of the actual breech but at a further remote region and thus does not contribute to the overall length of the breech.

As shown in FIG. 1, the end blocks 61, which provide the attachment of the guide bar 63, are fixed to the mounting tongue 11 by screws 69. Thus, when detaching the barrel 13, the breechblock 43 with its entire guidance mechanism 61, 63, 65, 67 can be removed as exchangeable unit by detaching the screws 69 and replaced by another guidance unit in case this is required for example for adjustment to the overall length of the breech mechanism and repeater system. The above-mentioned contour compensating element 37 may be designed such as to extend laterally along the positioning rail 19 and the mounting tongue 11 and to form a dust-tight cover for the guidance system disposed between positioning rail 19 and mounting tongue 11.

Figure 2:
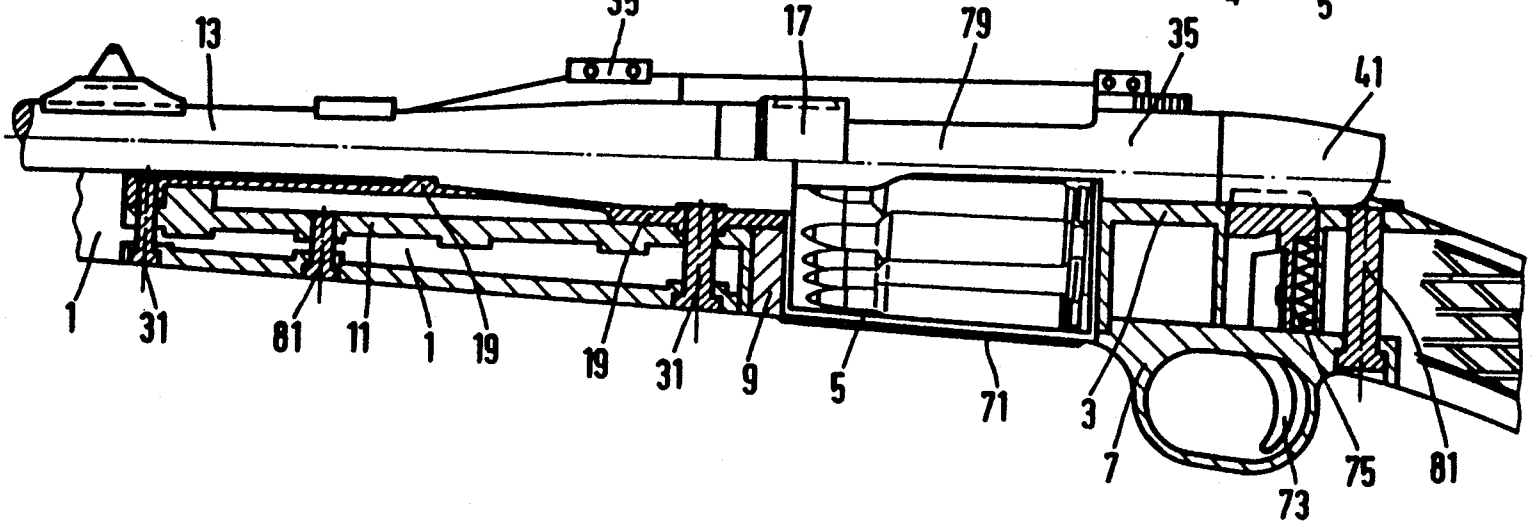
FIG. 2 shows a similar side view and sectional illustration of a firearm in form of a long repeating rifle.

The weapon illustrated in FIG. 1 is a repeating rifle of "short" design i.e. the magazine 5 is accommodated in the same longitudinal area as the trigger guard 7 and the trigger mechanism. This design is relative current in the field of hunting weapons; many hunters prefer the conventional "long" design of a repeating rifle which is illustrated in FIG. 2. In FIGS. 1 and 2, same reference numerals have been used for corresponding elements. According to FIG. 2, the magazine well provided for the magazine 5 and closable by a magazine cover 71 is arranged in direction of the barrel in front of the trigger guard 7 with trigger 73 and trigger mechanism 75, in correspondence with conventional designs. Also in this case, the trigger guard and magazine well form a system frame 3 which is forwardly continued by a mounting tongue 11 for allowing attachment of the exchangeable barrel 13 by means of the positioning rail 19 which is mounted to the barrel by fastening screws 31 as described with reference to FIG. 1. One and the same barrel 13, which in connection with the hitting accuracy constitutes the most cumbersome and most expensive component, can be selectively placed on shorter or longer repeating rifles according to FIG. 1 or FIG. 2. On the other hand, the one or the other rifle stock of short or long design according to FIG. 1 or FIG. 2 can be provided with exchangeable barrels 13 of different calibers to thereby create a modular system by which a great number of weapon types can be obtained. At given barrel caliber, a further variation is possible by using ammunition of different cartridge lengths for the concerned caliber. For that purpose, the magazine well is dimensioned to provide space for ammunition boxes of different length, with the above-mentioned locking bars 9 being provided to fill out the possibly remaining empty space. The long design according to FIG. 2 provides also more space in height for accommodating the ammunition box so that e.g. an ammunition box for five cartridges can be utilized while the short design according to FIG. 1 frequently provides space between the trigger guard 7 and the breech mechanism for only a three-shot magazine.

Figure 6:
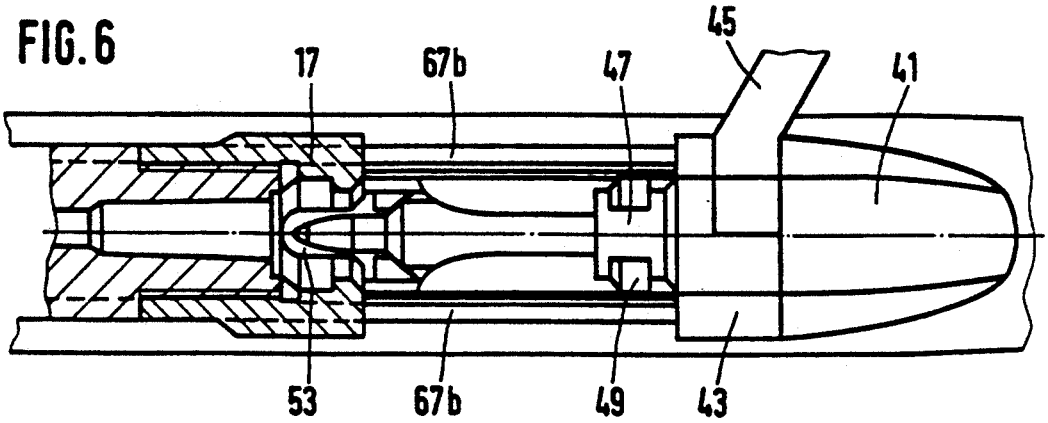
FIGS. 6 to 9 show partially sectional plan views of opened breech mechanisms in ammunition loading position, with different barrels and correspondingly different bolt heads.
Figure 7:
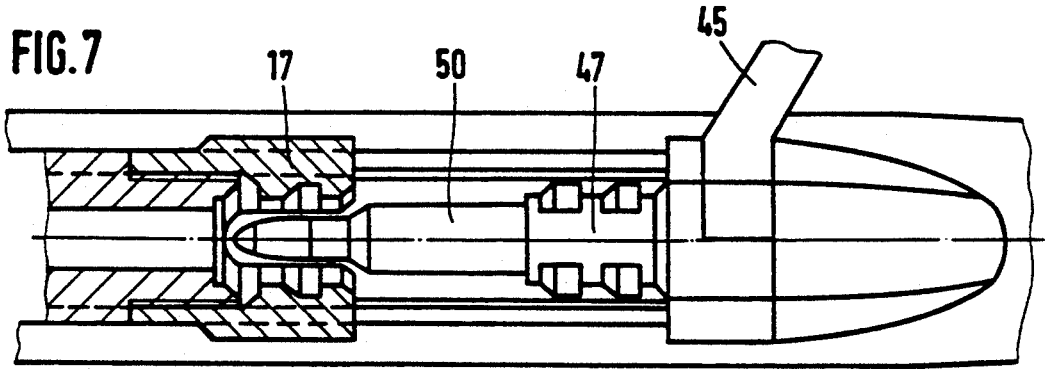
Figure 8:
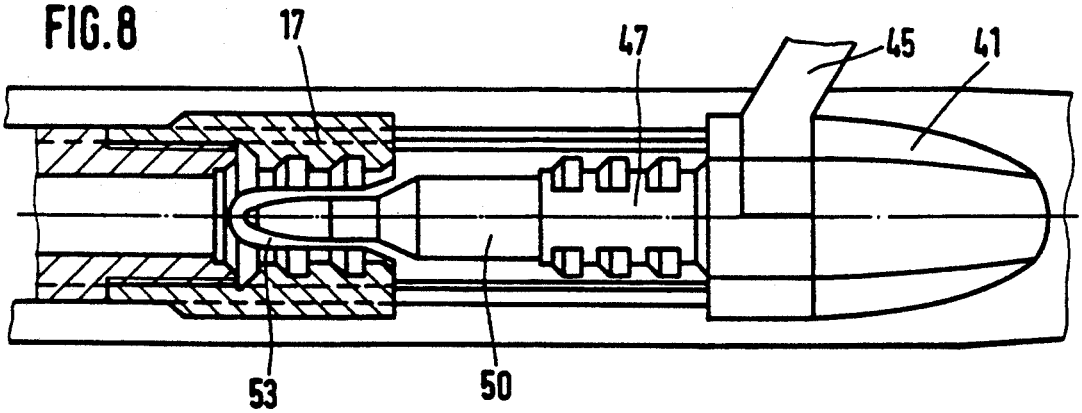
Figure 9:
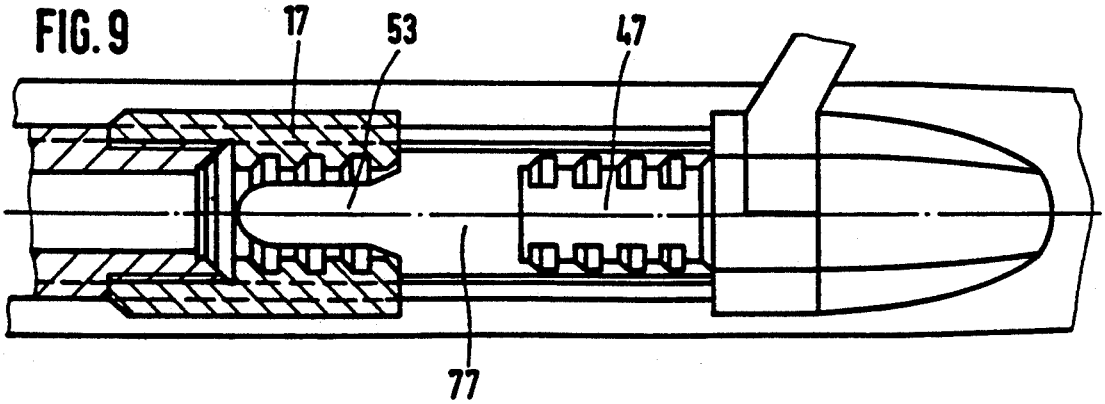

A further expansion of the modular system is attained by using instead of a repeater system of short or long design according to FIG. 1 and FIG. 2 a stock for a single-shot rifle which stock is also provided with the mounting tongue 11 for attachment of the exchangeable barrel 13. A single-shot rifle of this type does not have a magazine but instead a loading chamber in the breech mechanism for inserting single cartridges. Such a single-shot rifle is schematically shown as plan view in FIG. 9, with 77 designating the firing chamber while FIGS. 6, 7 and 8 illustrate plan views of breech mechanisms for a "short" repeating rifle according to FIG. 1.

In case of the long design as illustrated in FIG. 2, the guidance of the (not shown) breechblock can be assumed by a guide sleeve 79 in the area of the breech so that in this case no guidance system is required to be accommodated below the positioning rail 19 (as illustrated in FIG. 1 at 63, 65, 67). In FIG. 2, 81 designates screws for attaching the entire system frame 3 to the wooden gunstock 1.

For the short single-shot rifle, the same breech guidance system 63, 65, 67, 47 can be used as exchangeable unit as in case of the short repeating rifle.

A further advantageous but not shown feature of the invention is obtained by designing the barrel 13 in light-weight construction, with a highly precise steel core in which the grooves of the rifle are provided and with a jacket of high-strength aluminum alloy (Dural) which surrounds the core, preferably shrunk thereon, and determines the outer contour of the barrel. This design affords a substantially smaller weight of the barrel at same hitting accuracy, and moreover, the thickness of the wall of the Dural-jacket can be generously dimensioned so as to favorably influence the attenuation of vibrations of the barrel when firing a shot.

The magazine units 5 used in the repeater systems have preferably different subdivisions of the interior space for cartridges from caliber 0.222 Remington up to 0.275HH Magnum, and have a (not shown) cartridge shoulder support rib which interior space subdivisions simultaneously may have a cylindrical hollow for receiving conically shaped spiral springs in order to move the follower in the forward magazine area upwardly in sufficiently forceful and non-tilting manner.

All operationally relevant parts of the rifle and modular system according to the invention are preferably made and machined in CNC-manufacturing technics.

As described, the modular system according to the invention targets the assembly of three different weapon types, each with selectable caliber:

A: Traditional repeater with great magazine capacity for pressure hunting and hunting of African or fighting big game, in respectively big caliber, with the possibility to fire from the same weapon smaller cartridges by exchanging barrel and bolt head.

B: Short repeater with limited magazine capacity for still-hunting of precious trophies.

C: Short rifle without magazine, in extreme lightweight construction and for special caliber, for extremely far shots in high mountain regions and most difficult terrain.

The basic type is the short repeater with respectively designed system frame 3, mounting tongue, with magazine well and the barrel positioning rail 19. This important constructional element is fixedly secured in the stock 1, forms a metallic constructional unit with the magazine well arranged in the rear area, and in the forward area is designed for receiving the barrel positioning rail 19 and is provided for receiving the novel guide unit 63, 65, 67 for the breech 47.

In case the guide unit 63, 65, 67 and the exchangeable barrel 13 are threadably engaged on the stock 13 via the mounting tongue 11, the bolt handle 45 with pertaining breech cover 41 and integrated group of striking pins is inserted from the rearward side in the guide bearing, and by inserting the respective bolt head 47 from the forward barrel-facing side and attachment through a stud bolt, the readied short repeater is obtained with caliber 0.222 Remington. The exchangeable magazine which is pushed from above into the magazine well and is subdivided for cartridges 0.222 Remington, is charged with cartridges outside of the weapon and then inserted in the weapon until locked in place.

Exchange of the barrel 13 is attained by loosening both fastening screws 31 at opened breech. After withdrawing the barrel 13, the pertaining bolt head 47 is taken out by removing the stud bolt.

Now, the short repeater—depending on existing change barrels—can be reequipped for a desired caliber. When using a barrel with stronger barrel contour, before inserting the barrel, the barrel contour compensating element 37 is removed from the front stock 1 by loosening the forward swivel screw 39 and substituted with an element suitable for the new barrel contour. The modular system according to the invention further comprises stock units for a long repeater with system frame 3 and guide sleeve 79, as well as a stock with system frame 3 for the single-shot short rifle. The latter is designed as an extremely light rifle with high-speed special caliber and long barrel. This is attained in that the very slender forward stock with system frame 3 of Dural is provided with a firing chamber instead of a magazine well and, in the same manner as in the short repeater (FIG. 1), is able to receive the guide unit 63, 65, 67 and the positioning rail 39 with barrel 13 via the mounting tongue 11.

In case a traditional long repeater with greater magazine capacity in classic caliber 0.375 Holland & Holland Magnum should be made available for hunting fighting game such as grizzly or buffalo, the respective barrel 13 is mounted on the mounting tongue 11 of the single-shot rifle by means of both screws 31 and the breech unit is extended to a long cylinder breech by inserting in the bolt handle 45 an extension piece instead of the bolt head. The respective bolt head 47 as well as the extension piece is attached by means of a stud bolt, and by sliding this functional constructional unit into the guide sleeve 79, the weapon is made ready for use.

I claim:

1. Firearm having a stock, an exchangeable barrel and a cylinder breech including a breechblock, with a coupling element arranged at the barrel underside and a coupling element arranged at the stock of the firearm and cooperating with the coupling element of the barrel for allowing detachably mounting of the barrel to the stock, and with guide means for guiding the breech block, characterized in that the coupling element of the barrel is a positioning rail (19) which parallels the barrel (13) and has a rearward part fixedly secured to the barrel (13) in the area of the cartridge chamber (15) and a forward part extending without contacting the barrel, that the coupling element of the stock is a mounting tongue (11) which extends over the length of the positioning rail (19) and includes at least at its forward and rearward ends fastening elements which interlock with the positioning rail (19), and that the guide means (63, 65, 67) for the breechblock (43) is arranged below the barrel (13) in the area of the mounting tongue (11).

2. Firearm according to claim 1, characterized in that the barrel (13) has at its rearward end a locking bush (17) with inwardly directed locking lugs (51), and further comprising a bolt head (47) exchangeably supported by the breechblock (43), with the bolt head (47) having locking lugs (49) which are axially engageable with the locking lugs (51) of the locking bush (17) for locking the bolt head (47) through rotation.

3. Firearm according to claim 2, characterized in that the locking bush (17) and the bolt head (47) have each at least one group of three locking lugs (49, 51) which are arranged at angular distances.

4. Firearm according to claim 3, characterized in that the locking bush (17) and the bolt head (47) have more than one group of three locking lugs (49, 51).

5. Firearm according to claim 3, characterized in that the locking bush (17) includes more than one group of three locking lugs (49, 51), with the groups of locking lugs being arranged successively in axial direction, and with the bolt head (47) including a number of groups of locking lugs corresponding to the number of groups of locking lugs of the locking bush.

6. Firearm according to claim 2, characterized in that the bolt head (47) has a depression (55) at its end face for receiving the bottom area of a cartridge.

7. Firearm according to claim 6, characterized in that the depression of the bolt head (47) has a diameter, and further comprising at least one further bolt head having a depression of a diameter differing from the diameter of the depression (55) of the bolt head (47) for allowing adaptation to different ammunition classes.

8. Firearm according to claim 6, characterized in that the edge of the bolt head (45) surrounding the depression (55) is downwardly cut out in order to allow the transverse-axial passage of the bottom area of a cartridge into the depression (55).

9. Firearm according to claim 6 characterized in that a part of the edge surrounding the depression (55) is defined by a pullout claw (57) swingably supported at the bolt head (47).

10. Firearm according to claim 2, with a barrel of small caliber, characterized in that the locking bush (17)

and the bolt head (47) have one group of three locking lugs (49, 51).

11. Firearm according to claim 1, characterized in that the mounting tongue (11) is part of a one-piece system frame (3) of metal which is inserted in the stock (1) and also receives the trigger guard and the trigger mechanism.

12. Firearm according to claim 11, and further comprising a magazine provided in the system frame and containing cartridges, characterized in that the locking bush (17) includes at its underside a cutout (53) for passage of the projectile nose of a cartridge (50) which is pushed from the magazine into the breech.

13. Firearm according to claim 11, characterized in that the stock with system frame is designed as short repeating rifle.

14. Firearm according to claim 11, and further comprising an ammunition box (5) mounted to the system frame (3) for use as a repeating rifle.

15. Firearm according to claim 11, characterized in that the stock with system frame is designed as long repeating rifle.

16. Firearm according to claim 11, characterized in that the stock with system frame is designed as short single-shot rifle.

17. Firearm according to claim 1, characterized in that the guide means includes a guide bar (63) mounted to the mounting tongue (11) and extending parallel to the barrel below the positioning rail (19) and a guide bush (65) slidably guided on the guide bar and connected with the guided breechblock (43) by two fastening straps (67) arranged laterally of the barrel.

18. Firearm according to claim 17, characterized in that the guide means (63, 65, 67) is detachably and exchangeably mounted to the mounting tongue (11).

19. Modular system for assembling a firearm, characterized in that it comprises:

at least two barrels (13) of different caliber, with each barrel (13) including a positioning rail (19) and a locking bush (17), wherein the positioning rail of one barrel is identical to the positioning rail of the other barrel while the locking bush of one barrel differs from the locking bush of the other barrel, at least two stocks (1), with each stock being provided with a system frame (3) with a mounting tongue (11), a magazine (5) and a breech for a short or long repeater system, wherein the mounting tongue, magazine and breech of one stock are identical to the mounting tongue, magazine and breech of the other stock, and at least two bolt heads (47) suitable for the locking bushes (17) of the barrels (13) and selectively insertable in the breech.

* * * * *